United States Patent [19]

Bannister

[11] Patent Number: 4,533,122

[45] Date of Patent: Aug. 6, 1985

[54] BARRIER SYSTEM

[75] Inventor: Brian C. Bannister, North Mymms, England

[73] Assignee: Marler Haley Exposystems Ltd., Hertfordshire, England

[21] Appl. No.: 386,038

[22] Filed: Jun. 7, 1982

[30] Foreign Application Priority Data

Jun. 10, 1981 [GB] United Kingdom ..... 8117820

[51] Int. Cl.[3] ..... E04F 11/18

[52] U.S. Cl. ..... 256/69; 256/1; 40/606; 404/9; 116/63 P

[58] Field of Search ..... 256/1, 65, 69, DIG. 5; 248/523, 519, 469, DIG. 10, 179, 219.2; 404/9, 10, 11; 116/63 P, 63 R; 40/606, 607; 182/178, 179

[56] References Cited

U.S. PATENT DOCUMENTS

| | | | |
|---|---|---|---|
| 1,918,116 | 7/1933 | Mansfield | 182/178 |
| 2,590,506 | 3/1949 | Carter | 40/606 |
| 2,781,017 | 2/1957 | Fuller et al. | 116/63 P |
| 3,119,588 | 1/1964 | Keats | 256/1 |
| 3,421,473 | 1/1969 | Weichenrieder | 116/63 R |
| 3,917,231 | 11/1975 | Fink | 256/1 |
| 4,124,196 | 11/1978 | Hipskind | 256/1 |
| 4,361,314 | 11/1982 | Ohlson | 256/65 |
| 4,361,982 | 12/1982 | Horowitz | 248/219.2 |

FOREIGN PATENT DOCUMENTS

| | | | |
|---|---|---|---|
| 183985 | 8/1922 | United Kingdom | 182/178 |
| 1578453 | 11/1978 | United Kingdom | 256/1 |
| 2102466 | 2/1983 | United Kingdom | 256/DIG. 5 |

*Primary Examiner*—Cornelius J. Husar
*Assistant Examiner*—Todd G. Williams
*Attorney, Agent, or Firm*—Parmelee, Miller, Welsh & Kratz

[57] ABSTRACT

A barrier system is disclosed in which uprights comprise columns, each surmounted by a head member including a slotted member affording a plurality of longitudinally extending slots opening onto an upper axial end face of the slotted member, and a cap which can be screwed down into engagement with said end face to close off the axial ends of the slots, the slots open onto the periphery of the slotted member via restricted throat portions, so that radial withdrawal of fitments of complementary form, for example provided on the ends of horizontal barrier rails, can be prevented.

8 Claims, 20 Drawing Figures

BARRIER SYSTEM

DESCRIPTION OF INVENTION

Figure 1B:
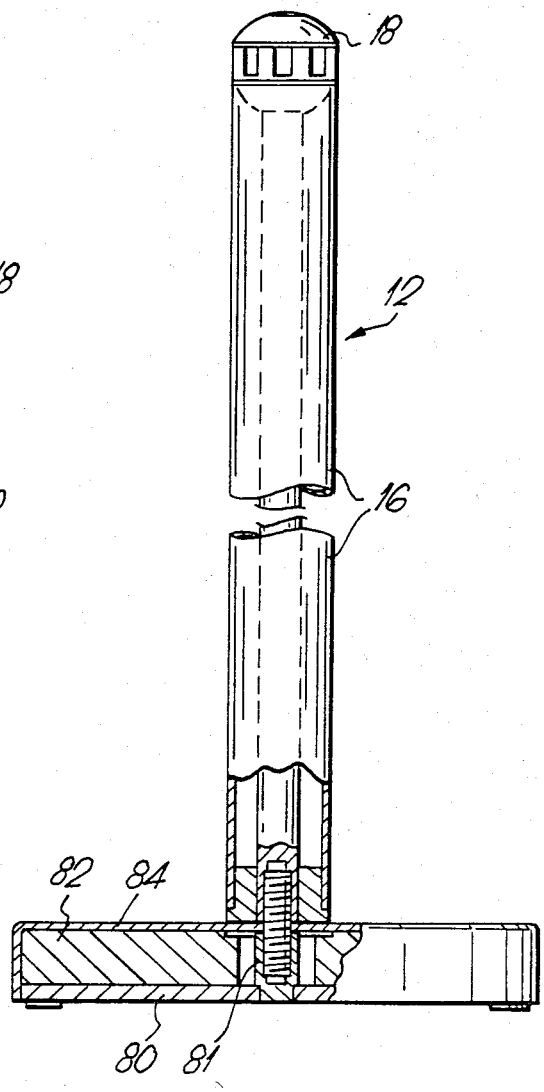

This invention relates to barrier systems, and more particularly to barrier systems of the kind comprising a series of uprights upstanding from the ground or floor surface, with adjacent uprights being connected by respective transversely extending rails, ropes, chains or the like.

Barrier systems of this kind are frequently used in public access buildings, such as exhibition halls and the like, for pedestrian guidance, queue control, space division etc.

Where such barrier systems are of a temporary nature, it is desirable that such systems should be adaptable, so that they can be used repeatedly at different locations and in different configurations, yet at the same time it is desirable that the components of such a system should be sufficiently robust, and be resistant to tampering and inadvertent disassembly whilst being capable of being readily disassembled and re-assembled when required.

It is an object of the invention, in one of its aspects, to provide an upright for a barrier system of the kind referred and by the use of which at least some of the above-noted desiderata may be achieved.

According to one aspect of the invention, there is provided an upright for a barrier system of the type comprising a plurality of uprights connected by rails, ropes or the like, the upright comprising a base, a column upstanding therefrom, and a head member mounted on the column, the head member providing a slotted member affording a plurality of peripheral slots each extending longitudinally and opening also onto one axial end face of the slotted member, and a cap which can be fixed in engagement with said end face of said slotted member to close off the axial ends of said slots, and can be separated from said end face to allow insertion of fitments longitudinally into said slots, said slots opening onto the periphery of said slotted member via respective restricted throat portions, whereby radial withdrawal of fitments of complementary form from said slots can be prevented.

It is an object of the invention, in another of its aspects, to provide an upright for a barrier system of the kind referred to which incorporates readily operable retaining means whereby fitments such as sign boards, lamps, etc. may be mounted on the upright.

According to this aspect of the invention, there is provided an upright for a barrier system of the type comprising a plurality of uprights connected by rails, ropes or the like, the upright comprising a base, a column upstanding therefrom, and a head member mounted on the column, the head member comprising an axial passage therethrough, an internal clutch with an expansible collet around said axial passage, and means carried by externally accessible parts of said head member, relatively movable with respect to one another to operate said clutch, whereby an elongate insert can be inserted in said axial passage and gripped by said collet.

The invention also comprises within its scope a head member for an upright according to either of the above aspects of the invention and a barrier system incorporating uprights according to either of said aspects.

Figure 1A:
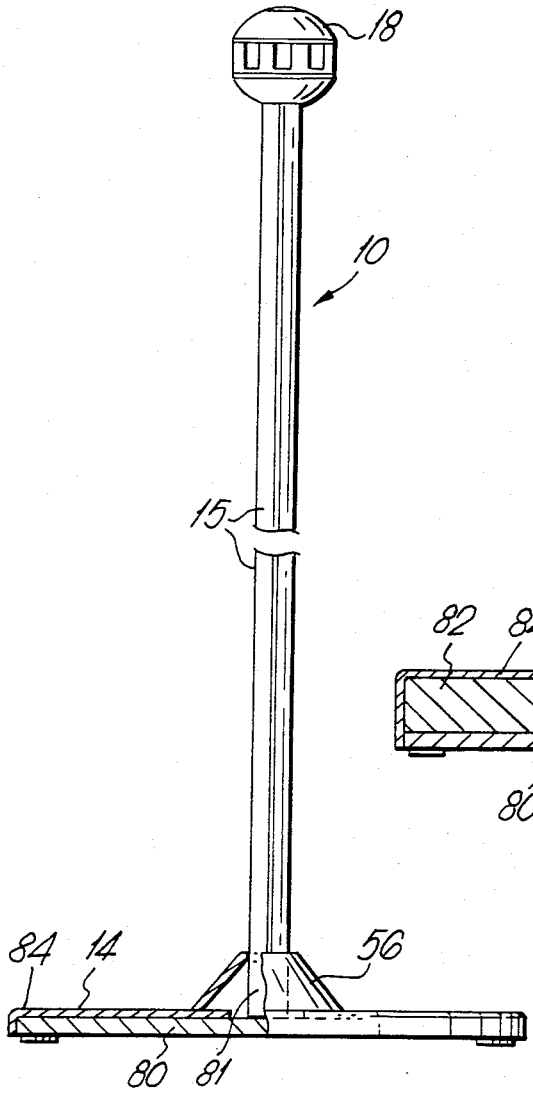
Figure 2A:
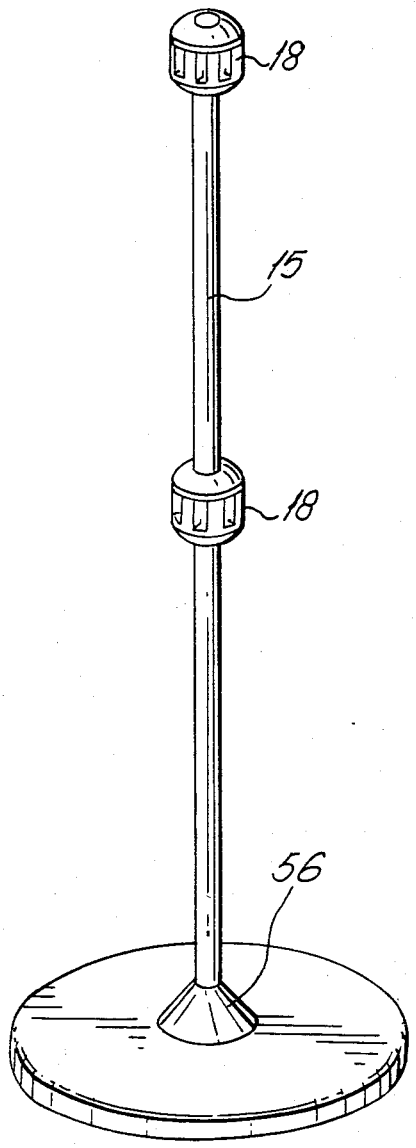
Figure 2B:
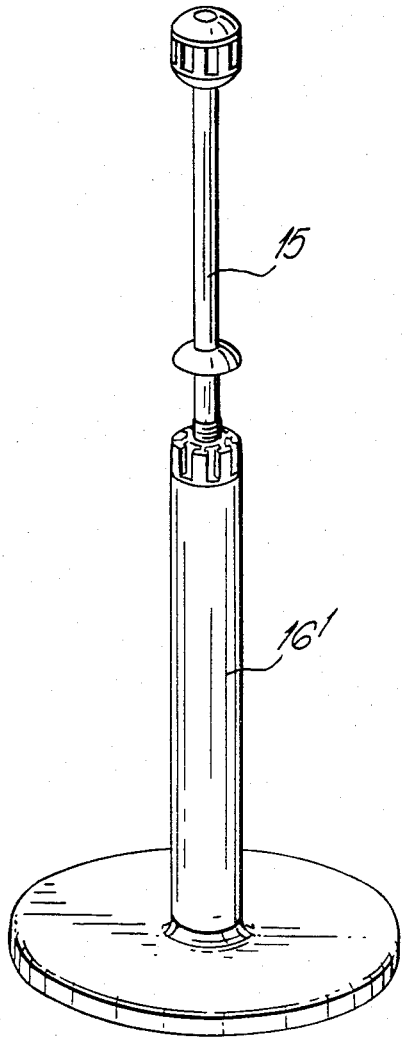
Figure 3:
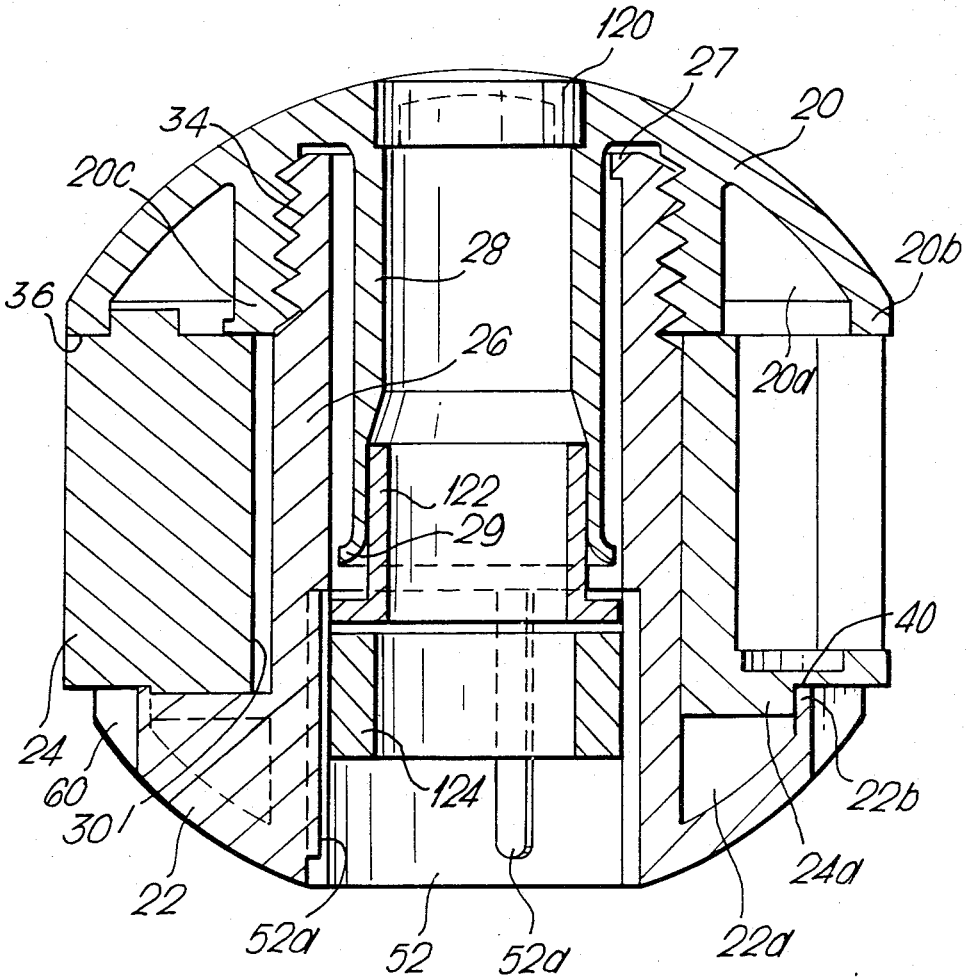
Figures 4, 5:
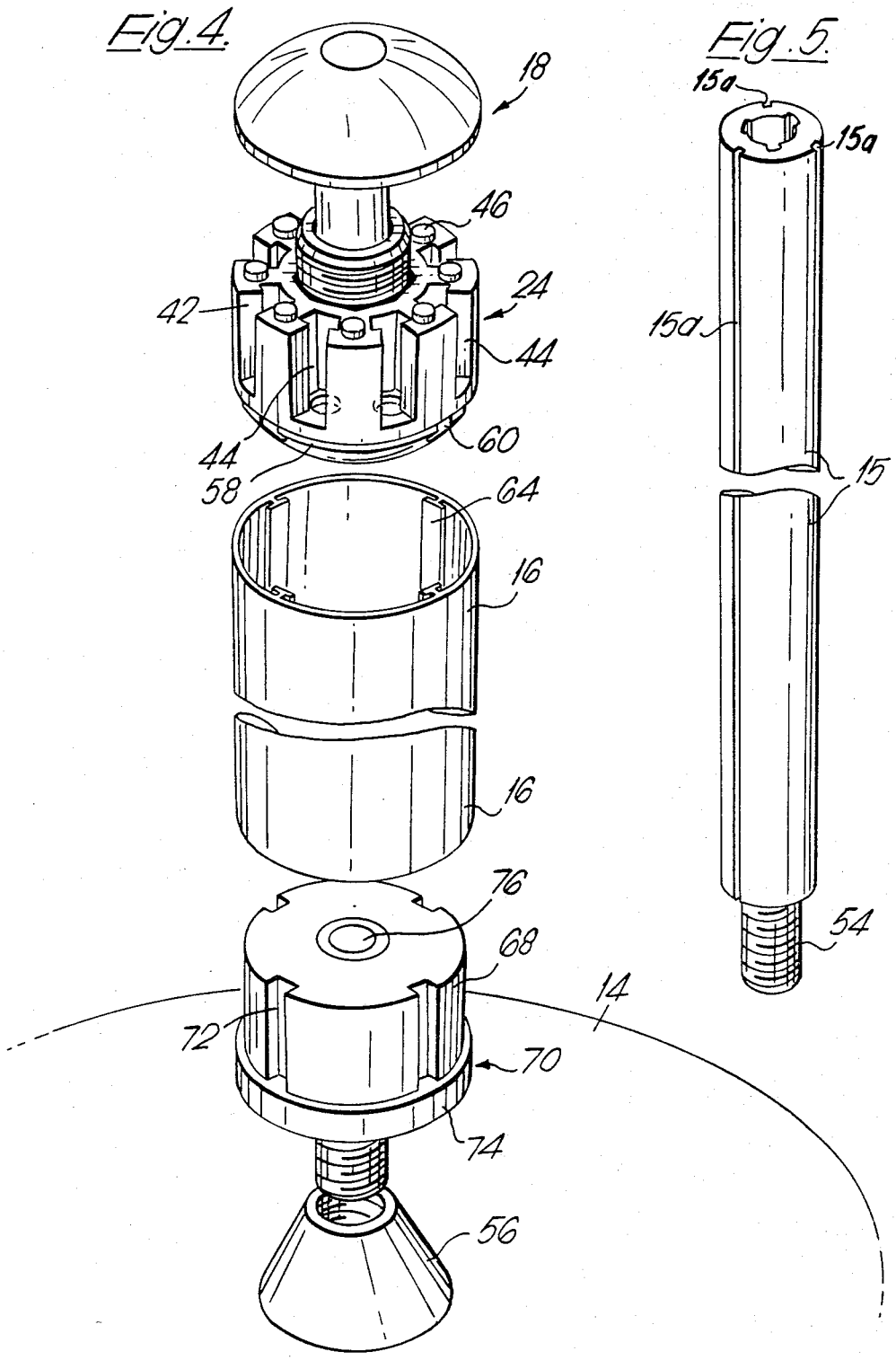
Figure 6:
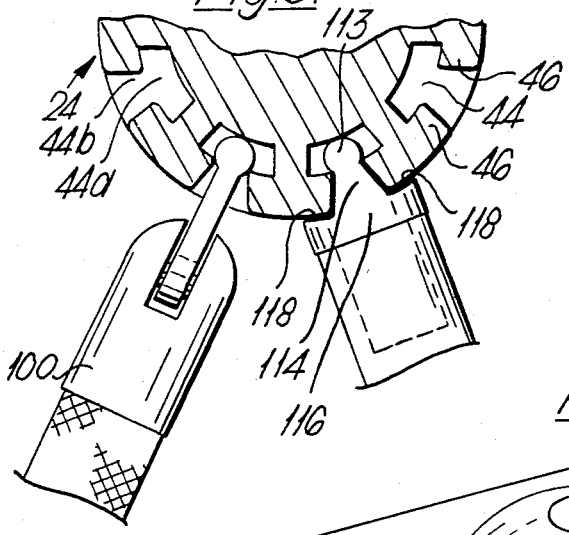
Figure 7:
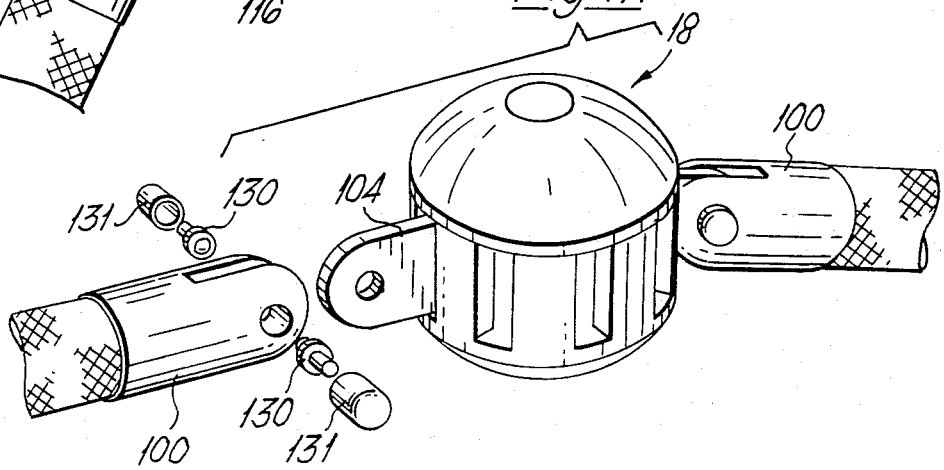
Figure 8:
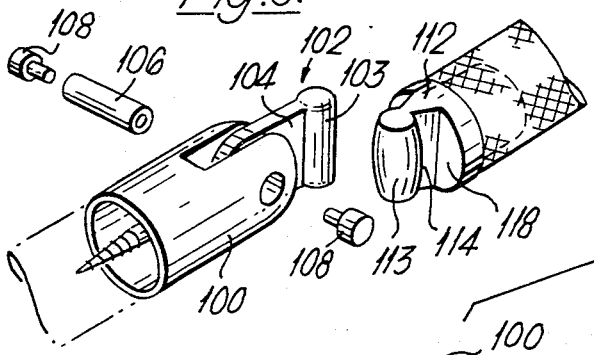
Figure 9:
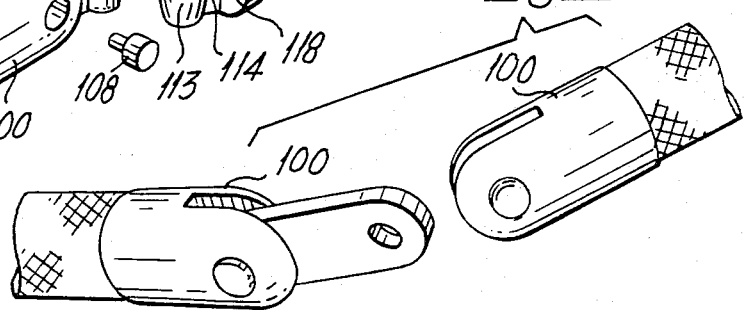
Figure 10:
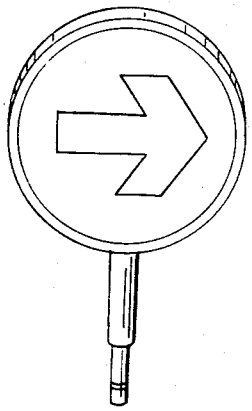
Figure 11:
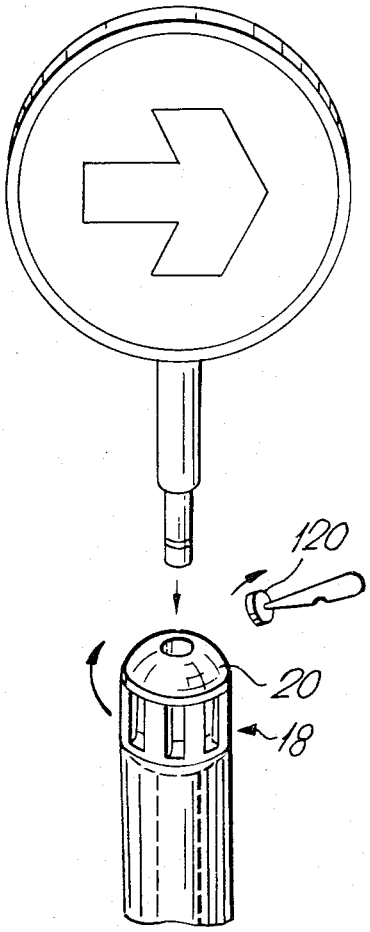
Figure 12:
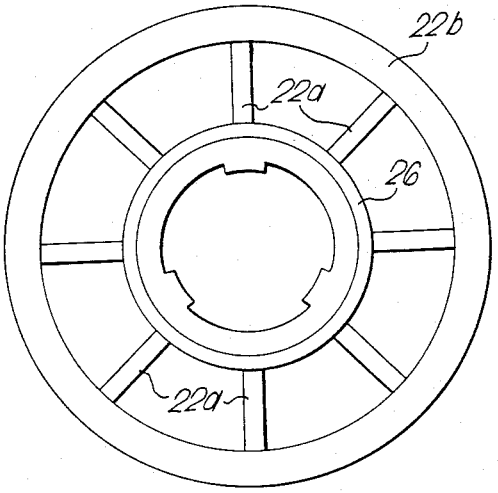
Figure 13:
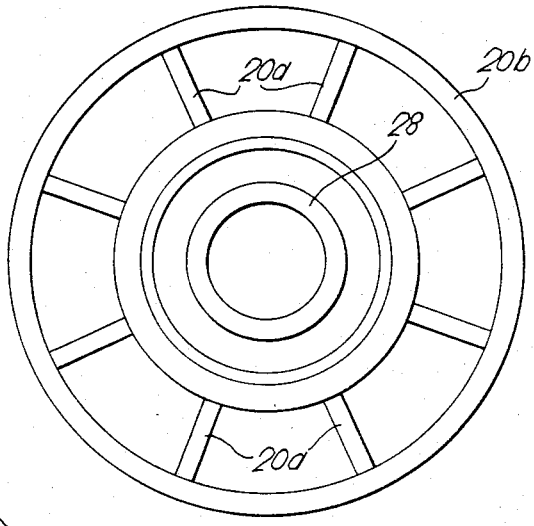
Figure 14:
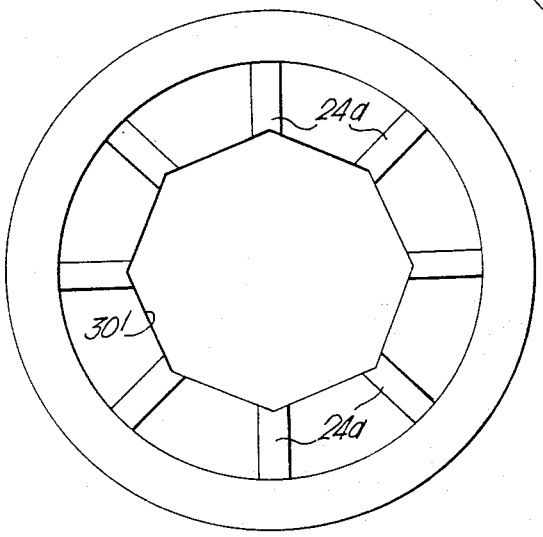
Figure 15:
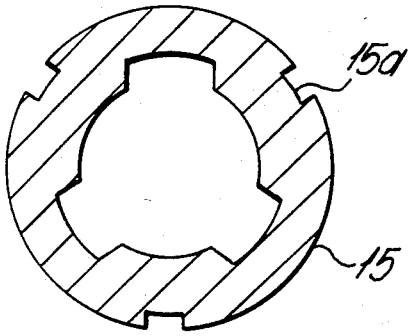
Figure 16:
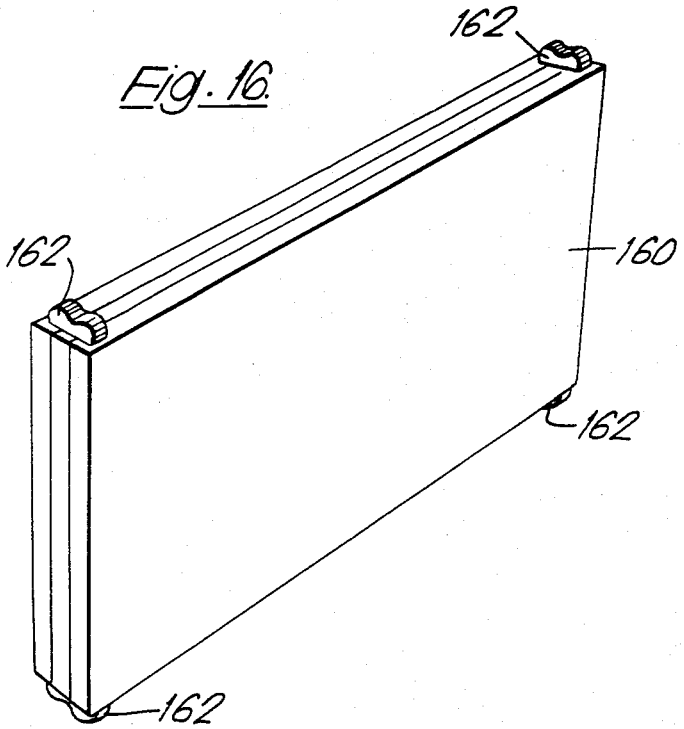
Figure 17:
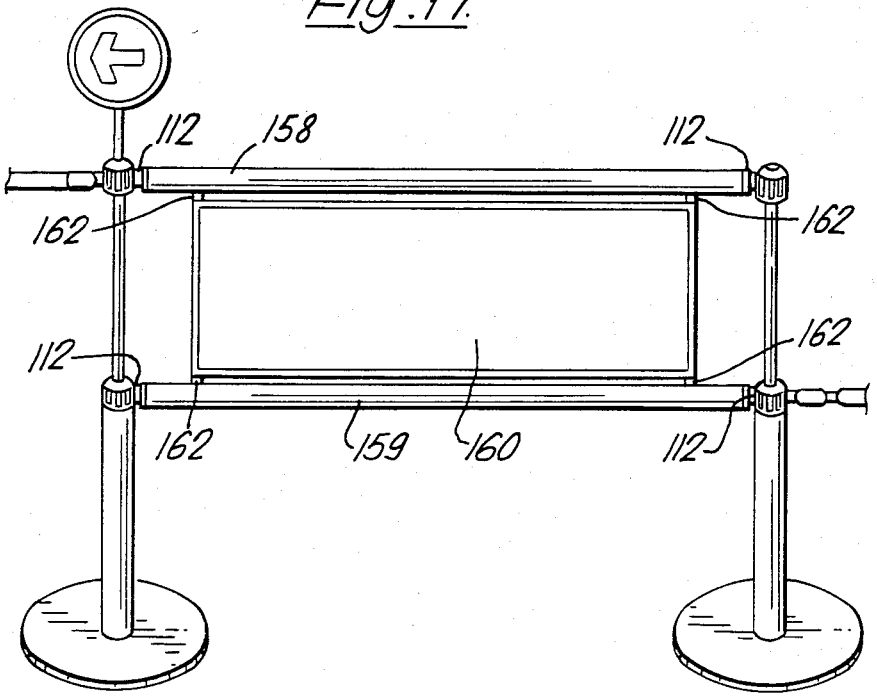
Figure 18:
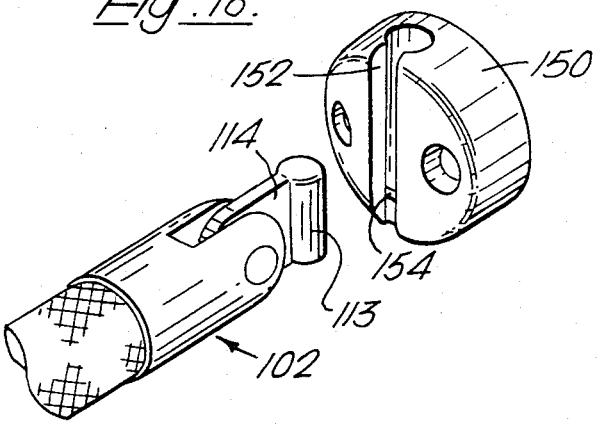

Embodiments of the invention are described below with reference to the accompanying drawings in which:

FIGS. 1(*a*) and 1(*b*) show, partly in side elevation and partly in section, different forms of upright embodying the invention, FIG. 2 illustrates at (*a*) and (*b*), in perspective, two variant uprights, FIG. 3 shows, in axial section, a head member forming part of the uprights of FIGS. 1 and 2, FIG. 4 is an exploded perspective view of the upright of FIG. 1(*b*), incorporating the head member of FIG. 3, FIG. 5 is a perspective view showing an alternative form of column which may be utilised to provide an upright as shown in FIG. 1(*a*), FIG. 6 is a schematic view, partly in horizontal section, showing the manner in which rail fitments may be attached to the head member, FIG. 7 is a perspective view illustrating a snap mounting for a rail in conjunction with the head member, FIG. 8 illustrates, in perspective, two other forms of rail fitment which may be used in conjunction with the head member, FIG. 9 illustrates a releasable connection which may be provided between two flexible rail members, FIG. 10 illustrates a fitment which may be used in conjunction with uprights of the system, FIG. 11 illustrates the manner of mounting such fitments in an upright, FIG. 12 is a plan view from above of the base of a head member, FIG. 13 is an underneath plan view of the cap of the head member, FIG. 14 is an underneath plan view of the slotted member in the head member of FIG. 13, FIG. 15 is a view in section of a column member for use in conjunction with the head member of FIG. 3, FIG. 16 is a perspective view of a display panel which may be used in conjunction with the barrier system, FIG. 17 is an elevation view showing the mounting of the display panel in a barrier system embodying the invention, and FIG. 18 is a perspective view showing the manner of mounting a rail of a barrier system to a wall.

The barrier system to be described with reference to the drawings is of the general kind comprising a series of uprights upstanding from the ground or floor surface, with adjacent uprights being connected by respective transversely extending rails, ropes, chains or the like. Such barrier systems are frequently used in public access buildings, such as exhibition halls and the like, for pedestrian guidance, queue control, space division, etc.

As the novel features of the embodiments to be described reside principally in the uprights of the system, in the end fittings for the respective transversely extending rails, ropes, chains or the like, and in certain intermediate fittings therefor, and as the general form of barrier systems of this kind is well known, a full barrier has not been illustrated in the drawings, as the respective forms of barrier concerned will be evident to those skilled in the art from the following description.

Referring to FIGS. 1(*a*) and 1(*b*), two forms of upright, embodying the invention, are illustrated.

The uprights indicated generally at 10 and 12 in FIGS. 1(*a*) and 1(*b*) respectively each comprise a base 14 in the general form of a circular plate, a column member 15 (FIG. 1(*a*)), 16 (FIG. 1(*b*)) and surmounting the column member, a round head member 18.

As shown in greater detail in FIGS. 3 and 4, the head member 18 provides, distributed regularly around its vertical axis, a plurality of fitment recesses 44 opening onto the circumference of the head member. In use, fitments at the ends of respective rails, ropes or the like of the barrier system are received in selected said fitment recesses 44 in a manner to be described.

The head member is substantially circular as viewed in plan and, as shown in FIGS. 3 and 4, comprises an upper mushroom-shaped cap 20, a base 22 having the general form of an inverted mushroom and an intermediate member 24 located between the wider portions of the cap 20 and base 22. The base 22 shown in plane in FIG. 12, comprises a hollow, generally cylindrical stem 26 extending upwardly from the wider portion of the base, while the cap 20 includes a hollow cylindrical stem 28 extending downwardly from the wider portion of the cap, within the stem 26, the stem 28 being a free, axially sliding fit within the stem 26. The stem 26 has, at its upper end, an externally screw-threaded portion 34 which is threadedly engaged in the correspondingly threaded outer wall of an annular recess formed in the upper portion of the cap 20 around the stem 28. The remainder of the stem 26 is substantially cylindrical externally with a diameter corresponding to the crest diameter of the thread on portion 34, and is received closely within an internal passage 30, of octagonal section, extending axially through the member 24.

If desired, the member 24 may be adhesively bonded to the base 22, for example by adhesive between the stem 26 and bore 30. Alternatively, the member 24 may simply be a tight fit on the stem 26, or may even, if preferred, be rotatable thereon. The cap 20, shown in vertical section in FIG. 3, is also shown in underneath plan view in FIG. 13.

The wider, lower portion of the base 22 and the wider upper portion of the cap 20 are substantially of shell-like form. The wider, lower portion of the base 22 has radial reinforcing webs 22*a* as best shown in FIG. 12, while the wider, upper portion of the cap 20 has radial reinforcing webs 20*a*, as shown in FIG. 13.

The cap 20, at its periphery and at the lower end of a tubular part which bounds said annular recess has a substantially planar undersurface 36 perpendicular to the vertical axis of the head member, while the base 22 has likewise, at its periphery a substantially plane surface 40 facing upwardly towards the cap 20. The member 24 has, externally, the general form of a cylinder of the same diameter as the rim of the cap 20, the cylindrical surface of the member 20 being interrupted at regular intervals by longitudinally extending slots 42 forming the entrances to the fitment recesses 44.

As shown in FIG. 4 and FIG. 6, each of said recesses 44, as viewed in section perpendicular to the vertical axis, includes an inner, enlarged portion 44*a*, bounded, on its radially outer side, by flanges 46 defining therebetween a throat 44*b* which is of restricted circumferential width, each recess 44 preferably widening, from said throat 44*b* in the direction radially outwardly from the vertical axis, to provide each said recess with an outwardly flaring entrance portion.

Each of the recesses 44 is in the form of a longitudinally elongate slot of constant cross section in planes perpendicular to the vertical axis and opens onto the upper surface of the member 24, which upper surface, apart from projections 46 each extending from a respective solid region of the member 24 between the throats 44*b* of two adjoining slots 44, is substantially planar, and cooperates with the planar under-surface 36 of cap 20. The ribs 20*a* are set back from the plane of surface 36 to an extent greater than the extent to which projections 46 project from the upper surface of member 24 so as to be out of the rotational path of projections 46. The lower surface of the member 24 shown in plane in FIG. 14, comprises a radially inner portion which is substantially planar but is interrupted at intervals by radially extending grooves 24*a* (see FIG. 14), in which, in the fully screwed-up position of the head member, receive the ribs 22*a*, and a radially outer portion which is set back, i.e. upwardly, with respect to the radially inner portion, for engagement with the surface 40 at the periphery of the base member 22, is likewise substantially planar, cooperating with the surface 40 of the base 22, and the recesses 44 are closed at their lower ends by relatively thin webs 50, so that the lower ends of the recesses 44 are disposed slightly above the level of the surface 40.

The base member 22 has a substantially cylindrical counter bore 52 extending axially from its lower surface upwardly and formed as an enlarged continuation of the axial passage through the stem 26.

The counter bore 52 is formed with three longitudinally extending inwardly projecting ribs 52*a* distributed equiangularly around the axis of the head, to locate in correspondingly spaced longitudinal grooves 15*a* on the exterior of a column member 15, which has the cross-sectional form shown in FIG. 15 and which is shown in perspective in FIG. 5.

In an upright of the form shown in FIG. 1(*a*), the head member 18 is fitted on a column 15 in the form of a cylindrical tube of the cross-section shown in FIG. 15 the upper end of which tube is received as a close fit within the bore 52 and is adhesively secured to the member 22. The lower end of the column 15 carries, as shown in FIG. 5 a screw 54 which is screwed into a screw-threaded bore in a central spigot 81 of a base disc 80 of base 14. In an upright of the form shown in FIG. 1(*b*), the column 16 takes the form of an extruded plastic pipe, having an external diameter the same as that of the member 24 and cap 20 and being internally dimensioned to fit closely over a marginal portion 58 of the base member 22. The portion 58 of the base member 22 is substantially cylindrical and co-axial with the remainder of the heat, but is interrupted at intervals around its periphery by longitudinally extending slots 60 formed through the base member. The internal form of the column member 16 is substantially cylindrical except for inwardly projecting, longitudinally extending ribs 64, which may be substantially T-shaped in cross section as shown in FIG. 4, these ribs 64 corresponding in number and angular spacing to the slots 60, so that the head member may be fitted into the upper end of the tubular column 16 with the cylindrical portion 58 being snugly engaged by the cylindrical portions of the inner wall of the member 16 and the ribs 64 engaging in the slots 60. The portion of the lower surface of the member 24 at the outer periphery thereof which projects beyond the base member 22, in this arrangement, abuts the upper end of the column member 16 and the cylindrical peripheral surface of the member 24 is substantially flush with that of the column member 16. In this arrangement, a column 15, of the same kind as used in FIG. 1*a*, is also provided, enclosed within the member 16 and passing through a bore in a plug fitted at the lower end of the member 16. Alternatively, as shown in FIG. 4, the lower end of the column 16 is fitted over a spigot 68 of a bottom member 70, which spigot 68 has externally the form of a cylinder, of a diameter corresponding to that of the internal cylindrical surface of the member 16, the cylindrical surface of spigot 68 being interrupted by longitudinally extending grooves 72, corresponding to the grooves 60, which receive respective ones of the ribs 64. The bottom member 70 further includes an enlarged cylindrical portion 74 of an external diameter corresponding to that of the member 16 and providing an upwardly facing annular shoulder which engages the lower end of the member 16. The underside of the member 70 is, where it is to be used in conjunction with a base having a cover plate of the form shown in FIG. 1*a*, recessed to receive the projecting portion 56 of the cover plate, and the member 70 has a screw-threaded axial through bore which receives a tubular, axially extending externally threaded insert 76 which, at its lower end, projects downwardly from the bottom member 70 and is in screw-threaded engagement with the axial screw-threaded bore in the spigot 81 of the base 14.

The base 14, preferably comprises, as shown, a circular sheet-metal base disc 80 from which extends upwardly a central spigot 81 which is formed internally with the screw-thread to receive insert 54; a cover plate 84 which fits over the base disc and is, in the embodiment shown, formed with the projection 56, and, if desired, an annular metal weight (82, FIG. 1(*b*)) fitted on top of the base disc and covered by the cover 84, to enhance the stability of the column. If desired, various thicknesses and weights of weight 82 with correspondingly formed cover members 84, may be provided. In this arrangement, the column 15 or the screw threaded end part 54 is screwed into a screw-threaded axial bore in the spigot 81.

The variant illustrated in FIG. 2(*a*) differs from that described with reference to FIG. 1(*a*) in that a further head member 18 is disposed intermediate the upper and lower ends of the column 15. In order that the intermediate head member 18 may be fitted over the column 15, the head member is bored out axially to the diameter of the bore 52, so that the stem 28 and parts carried thereby are removed and the upper portion of the passage through stem 26 is enlarged. Alternatively, of course, alternative caps, lacking the stem 28 may be manufactured specifically for the purpose. The intermediate head member 18 may be secured at the desired level by adhesive and/or by a pin inserted transversely in a bore drilled radially through a solid portion of the member 24, the stem 26 and the column 15.

The variant illustrated in FIG. 2(*b*) differs from that of FIG. 2(*a*) in that a shortened column 16' of the same cross section as the column 16 in FIG. 4, is interposed between the intermediate head member 18 and the base plate 14 only, the upper part of the column 15 being exposed. The cap 20 is shown raised in FIG. 2(*b*)).

The uprights described may be utilised in conjunction with transverse members, spanning the spaces between adjoining uprights and taking the form of rigid rails, ropes, chains or the like. Whatever the form of transverse member used, an attachment fitting, carried by the transverse member, is utilised which comprises an enlarged portion of a size to fit freely within the enlarged portion 44*a* of a recess 44 but too great to pass through the throat 44*b*, and which attachment fitting further comprises a neck portion of reduced thickness, compared with said enlarged portion, which can pass freely through the throat 44*b*. Thus as shown in FIG. 6 and FIG. 8, a transverse member comprising a rope may be fitted at either end with a respective cap 100 to which is pivotally connected a fitment 102 which has the general form of a cylindrical body 103 from which extends radially, substantially in an axial plane of the body 103, a plate 104 of substantially smaller thickness than the diameter of the body 103. As shown in FIG. 6, in use, the cylindrical body 103 is held captive in the desired recess 44, while the plate 104 extends through the throat 44*b* of the recess to the cap 100. The pivotal connection between the cap 100 and the member 102 is effected as follows. The plate 104 is a free fit in a longitudinal diametral slot formed through the free end of the cap 100. Aligned bores are formed through the plate 104 and the portions of the cap 100 on either side of said diametral slot, and through said bores is passed a pivot pin 106, preferably in the form of a hollow tube supported at either end by a respective cap 108 having a stem fitting within a respective end of the tubular pin 106 and which cap 108 is externally a tight fit in the bore in the respective part of the cap 100. As shown in FIG. 6, the flaring of the opening to the slot 44 allows pivoting of the member 102, and with it the cap 100 through a limited angle about the vertical axis of the member 103 relative to the head member 18.

When a rigid rail is utilised, it is preferred to use, at either end thereof, a fitment member 112, comprising a member 113, of a form similar to that of member 102 but connected with the remainder of the fitment member outside the respective recess 44 by a web 114 which is substantially wedge-shaped having relatively inclined flanks which bear closely against the correspondingly inclined flanks of the flared opening to the respective recess 44, to join with a portion 116 of the fitment member which is formed externally substantially as a continuation of the external surface of the rigid rail and preferably has shoulder portions 118 which fit snugly against the radially outer surface of the member 24. This form of fitment member is designed to fit firmly within the respective recess, without appreciable play. If desired, as shown in FIG. 8, the member 113 may be substantially barrel shaped, rather than simply cylindrical.

Fitting of the fitment members 102 or 112 in the selected recesses 44 is achieved simply by unscrewing the cap 20 from the stem 26 and drawing the cap 20 upwardly relative to the remainder of the head member as far as possible, as shown in FIG. 4, to define, between the cap 20 and the opposing surface of the member 24 a space of sufficient axial width to allow the insertion radially of the member 103 or 113 of the respective fitment member, the positioning of the same in vertical alignment with the desired recess 44 and the lowering of the fitment member into engagement in the recess 44. It will be appreciated that the vertical extent of the fitment members is small enough to allow the cap 20 to be thereafter lowered again and screwed fully home onto the stem 26.

In order to minimise loss of parts, for example through tampering, the stem 28 is preferably held captive within the stem 26, while permitting the necessary degree of vertical movement, by forming the stem 26 with inwardly turned tabs 27 at its upper end and forming the stem 28 with an outwardly turned lip 29 at its lower end, the tabs 27 and lip 29 being so dimensioned and fashioned that it is possible, during initial assembly of the head member, to fit the stem 28 within the stem 26 by forcing the lip 29 past the tab 27, such passage of the lip 29 past the tabs 27 being permitted by resilient deformation of the stem 26 and tabs 27, but subsequent removal of the stem 28 from the stem 26 being effectively prevented by abutment of the lip 29 with the tabs 27. The tabs 27 may, if desired, by replaced by a continuous internal lip.

The major portion of the cap 20, including the domed top and the stem 28 is formed as a unitary member which is provided with an axial passage, open at both ends and which extends through the stem 28. A separately formed cover plate 120 is engaged as a resilient force fit in a shallow counterbore at the upper end of this passage, so that the cover 120 and the unitary body forming the remainder of the cap 20 together define a substantially continuous domed or part-spherical upwardly presented surface or the cap.

It may occasionally be desired to mount, on the uprights, items such as signposts, information boards, or lamps, for example as illustrated in FIG. 10, and this is conveniently effected by providing these accessories with cylindrical spigots at their lower ends which can be extended through said axial passage through cap 20.

When it is desired to attach a fitment such as shown in FIG. 10, the cover 120 is removed, (see FIG. 11) by means of a suitable sharp instrument, so that the cylindrical spigot at the lower end of the fitment can be inserted in said axial passage, within the stem 28, from the upper end of the head member 18. The head member is provided with a clutch to grip such a cylindrical spigot, said clutch comprising a collet member 122 which is resiliently deformable inwardly and provides an axial through passage for such a spigot, the collet member having a radially outwardly extending flange at its wider, lower end which flange is located in the bore 52 between the shoulder, formed between the inner end of the bore 52 and the remainder of the passageway within the stem 26, and an annular support collar 124 which is adhesively secured within the bore 52. The lower end of the stem 28 is, adjacent its lower end, flared outwardly and downwardly frusto-conically, the arrangement being such that as the cap 20 is screwed into the stem 26 and thus the stem 28 lowered axially relative to the collet 122, the flared lower end portion of the stem 28 engages over the exterior of the collet 122 and deforms the same radially inwardly to grip against the surface of the cylindrical spigot inserted in the passageway within the stem 28. Conveniently the diameter of the cylindrical spigot and the dimensions and form of the clutch parts are such that in screwing down the cap 20, the last half turn prior to engagement of the cap 20 with the shoulder 32 and the member 24 serves to close the clutch sufficiently to grip the spigot firmly.

Both the base member 22 and the cap member 20 have peripheral lips 22*b* and 20*b* respectively which project axially beyond the respective radial reinforcing webs 22*a* and 20*a* respectively, afford the respective surfaces 40 and 36 and engage the radially outer ends of radially extending reinforcing sectors 24*a* on the underside of member 24 and the radially outer sides of the projections 46.

The axially facing surfaces of the webs 22*a* and the lip 22*b* engage opposing downwardly facing surfaces of the member 24, while the axially downwardly presented surface of lip 20*b*, and of a central collar 20*c* of cap 20, (which collar 20*c* is formed internally with the screw thread into which the cap is screwed) engage the opposing upwardly presented surface of the member 24.

In certain situations it may be desirable, or even essential, to present the possibility of providing a break in the barrier, for example in emergencies, and in such situations it is preferred to utilise a rope link or gate in which the connection of the end cap 100 with the plate 104 is such as to allow the end cap 100 to be separated from the plate 104 under a tension in excess of a predetermined limit. Thus, as shown in FIG. 7, in place of the pivot pin 106, ball catches 130 may be utilised, each ball catch comprising a housing received in the through bore in the part of the cap 100 on the respective side of the longitudinal slot and comprising a ball captively retained in the respective housing but displaceable therein against the bias of a spring within the housing, which spring urges the ball in the longitudinal direction of the respective bore in the slot to engage in the aperture in the plate 104 from the respective side of the plate 104. The ball housings 130 may be held in place in the respective bores by respective cover ferrules 131 fixed in said bores. With such an arrangement, if sufficient tension is exerted between the member 102 and the cap 100, the balls are forced resiliently into their respective housings allowing the plate 104 to be withdrawn from the respective slot. The cap 100 may be refitted to the plate 104 in the converse manner. As shown in FIG. 9 two similar ends of rope links may be similarly connected by means of a simple plate comprising two spaced-apart apertures each engaged by the ball catches in the respective end cap 100, so that the two links may be pulled apart as indicated when desired.

The form of the head member illustrated is convenient in that the three major components thereof, namely the cap 20, base 22 and slotted member 24 may be readily formed as respective injection mouldings. It would, of course, be feasible to form the member 24 integrally with the base 22.

When it is desired to terminate a rail of the barrier system on a wall or the like vertical surface, use may be made of a bracket of the form shown at 150 in FIG. 18, comprising a substantially disc-like body adapted to be secured by screws to the respective vertical surface and having, in its outer face, a vertical diametral slot 152 to receive the member 113 of a fitment member 102 or 112, the lower end of the slot being blocked by a peg 154 or the like disposed in the slot and the mouth of the slot being narrowed, with respect to its interior to hold the member 113 captive whilst allowing passage of web 114.

As indicated in FIGS. 16 and 17, in an arrangement utilizing columns of the kind shown in FIG. 2, with the upper head members of the two columns being connected by an upper rigid horizontal cylindrical bar 158 with fitments 112 and with the intermediate head members of the two columns being connected by a lower rigid horizontal cylindrical bar 159 with fitments 112, an information or advertising display board 160 may be incorporated in the form of a rectangular slab having at opposite ends of its upper and lower edge faces respective saddle-shaped members 162 providing respective arcuate recesses to receive the bars 158, 159, the board 160 thus being retained between the bars.

From the foregoing, it will be appreciated that the barrier system described with reference to the drawings is extremely versatile, being adapted to both light and heavy duty applications and various types and configurations of transverse members linking uprights. The form of the head 18 allows a large number of transverse members such as rails, ropes, etc. to be attached to a single upright, and/or allows a wide choice of angles between transverse members connected with a single upright. Furthermore, the uprights may also be utilised as supports for fittings, such as notice boards or placards, lamps, or the like.

I claim:

1. An upright for a barrier system of the type comprising a plurality of uprights connected by rails, ropes or the like, the upright comprising a base, a column upstanding therefrom, a head member mounted on the column, the head member including a first part and a second part, means securing said first part to the column, said first part affording a plurality of peripheral slots each extending longitudinally and opening also onto one axial end face of the first part, said slots opening onto the periphery of said first part via respective restricted throat portions, whereby radial withdrawal of fitments of complementary form from said slots can be prevented, the first part including a central portion, said second part of the head member further comprising a cap having a central portion, a peripheral skirt spaced outwardly from said central portion of the cap and providing an end face opposing said end face of the first part, and capable of mating engagement with said end face of the first part to close off the axial ends of said slots, the central portion of the cap and the central portion of the first part having inter-engaging screw threads thereon about a longitudinal axis of the head member whereby the cap can be screwed down into the first part, to engage, by said end face of said skirt, said end face of the first part, by rotation of the cap, relative to the slotted member, about said axis or can be unscrewed to move said end face of the cap skirt away from said end face of the slotted member to space said end faces from one another and allow insertion or removal of fitments into or from said slots, said head member having a passage extending therethrough along said longitudinal axis, through the slotted member and the cap member, an internal clutch within said passage including a collet carried by one of said part of the head member and means for contracting said collet carried by the other of said parts of the head member, whereby said collet contracting means can be operated to contract the collet by screwing said cap down onto the slotted member.

2. The upright of claim 1 including means holding said cap captive on said first part.

3. The upright of claim 1 wherein a removable insert is fitted in the passage through the cap at the upper surface of the cap.

4. The upright of claim 1 wherein said cap is generally mushroom-shaped having a top providing said skirt and a stem extending centrally from said top along said axis, an axial passage extending longitudinally through the top and stem, an axial passage of greater diameter extending through said first portion and receiving said stem as a free fit.

5. The upright of claim 4 wherein said collet is held captive within said larger diameter passage in said first portion, and said collet contracting means comprises a frusto-conical surface formed internally in said stem around said passage, said frusto-conical surface increasing in diameter towards said free end, the collet having an end of an external size to engage within the wider region of the frusto-conical part of the passage through said stem, but too great to pass freely through the narrower region of the frusto-conical part of said passage through said stem, whereby when the cap is screwed down onto said first portion, said frusto-conical surface is forced over the collet to contract the collet radially.

6. The upright of claim 5 wherein said passage through the first portion, at its end nearer the top of the cap, has an internal annular bead providing a shoulder facing along said passage away from the top of the cap, while said stem has, adjacent its end remote from said top, an external annular bead providing a shoulder facing along said passage in the first part towards the top of the cap, the bead on said stem being too great in diameter to pass through said bead on the first part without deformation, whereby separation of the cap from said first part is prevented by mutual abutment of said shoulders so that the cap is held captive on said first part.

7. The upright of claim 5 wherein said first part of said head member includes a component of inverted mushroom shape comprising an enlarged lower part and a stem upstanding axially from said lower part, and further includes a further component having a central aperture through which said stem of the inverted mushroom-shaped part extends, said further component providing said peripheral slots, said further component being located axially between said enlarged lower part of the inverted mushroom-shaped component and the top of the cap, said stem of the inverted mushroom-shaped component having a screw thread at its upper end, and the cap having a complementary screw-thread engageable with that at the upper end of the stem of the inverted mushroom-shaped component.

8. The upright of claim 7 wherein said screw thread on the stem of the inverted mushroom-shaped component is an external thread and said top of said cap is provided with an annular wall concentric with said stem of the cap and spaced outwardly therefrom, said screw thread on the cap being formed internally on said annular wall.

* * * * *